United States Patent [19]

Stahlecker et al.

[11] Patent Number: 4,606,184

[45] Date of Patent: Aug. 19, 1986

[54] ARRANGEMENT FOR STOPPING AND STARTING AN OPEN-END FRICTION SPINNING UNIT

[75] Inventors: Fritz Stahlecker, Josef-Neidhart-Strasse 18, 7347 Bad Ükerkingen; Hans Stahlecker, Haldenstrasse 20, 7334 Süssen, both of Fed. Rep. of Germany

[73] Assignees: Hans Stahlecker; Fritz Stahlecker, both of Fed. Rep. of Germany

[21] Appl. No.: 692,113

[22] Filed: Jan. 17, 1985

[30] Foreign Application Priority Data

Jan. 17, 1984 [DE] Fed. Rep. of Germany ..... 3401316

[51] Int. Cl.[4] ..... D01H 15/02; D01H 1/135

[52] U.S. Cl. ..... 57/263; 57/261; 57/401

[58] Field of Search ..... 57/400, 401, 409, 261, 57/263

[56] References Cited

U.S. PATENT DOCUMENTS 4,367,623 1/1983 Parker et al. ..... 57/401 X
4,380,892 4/1983 Parker et al. ..... 57/401

FOREIGN PATENT DOCUMENTS 0034427 8/1981 European Pat. Off. .

*Primary Examiner*—John Petrakes
*Attorney, Agent, or Firm*—Barnes & Thornburg

[57] ABSTRACT

For the stopping and starting of an open-end friction spinning unit or of a spinning machine consisting of a plurality of such open-end friction spinning units, it is provided that the switching-off of the drives takes place in such a controlled manner that the yarn end forming by means of the switching-off of the fiber supply remains in the sphere of action of an auxiliary suction device. As a result, the restarting and the connected piecing are facilitated since the yarn end, in a controlled manner, remains inside the spinning unit and does not have to be returned by additional means. The yarn end is sucked into an auxiliary suction device and is preferably clamped in at least during the stoppage of the spinning unit or of the machine.

17 Claims, 5 Drawing Figures

ARRANGEMENT FOR STOPPING AND STARTING AN OPEN-END FRICTION SPINNING UNIT

BACKGROUND AND SUMMARY OF THE INVENTION

This invention relates to a process for stopping and starting an open-end friction spinning unit having two friction rollers that are arranged next to one another to form a wedge-shaped gap serving as a yarn forming point or region. The friction rollers are drivable in the same rotational direction by a driving arrangement. A feeding and opening device is connected to drives for the feeding of single fibers to the wedge-shaped gap and a withdrawal device is connected to a drive for the withdrawal of the formed yarn in the longitudinal direction of the wedge-shaped gap. A suction device is connected to a vacuum source for holding the fibers and the forming yarn in the wedge-shaped gap and a wind-up device is connected to a drive for winding the formed yarn onto a spool. An auxiliary suction device is provided for holding a yarn end, which auxiliary suction device is connected with a vacuum source and is aimed against the withdrawal direction of the yarn at the area of the wedge-shaped gap.

An open-end friction spinning unit is disclosed in European Published Unexamined Application (EP-OS) No. 34 427 where, after a yarn breakage, a manual piecing process takes place. The stopping of the spinning unit does not take place in a specified sequence so that, after a stoppage, a starting must be carried out by means of a corresponding manual piecing at the spinning unit that is accelerated again to operational speed. During this piecing, the spool is lifted off the wind-up device so that its drive is interrupted. Then a yarn end is wound off and shortened to a predetermined length and is used for piecing. The length of the yarn end is such that it is sufficient for a return into the area of the mouth of a fiber feeding duct. By-passing the withdrawl device, the yarn end is led to a yarn withdrawal tube and is subsequently sucked into the spinning unit. The yarn end is sucked into the spinning unit by the suction device affecting the wedge-shaped gap. In the case of this open-end friction spinning unit, it is also provided that by manual operation a suction slot of the suction device can be closed gradually starting from the area beginning at the yarn withdrawal tube so that consequently the yarn end is sucked into the spinning unit with a decreasing suction slot. As an extension of the wedge-shaped gap, an auxiliary suction device is located on the side that is opposite the withdrawal device which has the purpose of holding the yarn end tautly when the suction slot is completely closed. The end of the yarn end is not sucked into the auxiliary suction device but is held in the area of the mouth of a fiber feeding duct, where it has to be held in such a way that in a stretched condition it is held at a distance from the wedge-shaped gap. By means of switching on the suction device while the suction slot is opened up again, the end of the yarn end is to place itself in a stretched position in the wedge-shaped gap. When the suction device is switched on again, the feeding is started, after which the yarn withdrawal is started by placing the spool on the wind-up device. Then the pieced yarn is again placed in the withdrawal device. This type of piecing is very time-consuming and also unreliable since the return of the yarn end cannot really be controlled. In particular, such a piecing can no longer be carried out economically when a large number of such open-end friction spinning units are to be combined to form a complete machine which, after a stoppage, must then be started again.

This invention is based on the objective of providing a process of the initially mentioned type by means of which the piecing can be facilitated in a minimal amount of time, this process also being suitable especially for large-scale piecing or start spinning in the case of a spinning machine consisting of a plurality of open-end friction spinning units.

This objective is achieved according to the invention by coordinating the stopping of the drives and the switching-off of the vacuum source of the suction device in such a way that the yarn end forming by means of interruption of the fiber feeding remains in the sphere of action of the auxiliary suction device into which it is sucked before a restarting.

In this manner, the stopping of the open-end friction spinning unit, or the stopping of a complete spinning machine consisting of a plurality of such open-end friction spinning units, takes place in such a controlled way that the yarn end takes up a controlled position. The yarn end will then be located either in a position where it is ready to be pieced or it can reach such a position automatically in a very simple way.

In a further development of the invention, it is provided that during the restarting, before the switching-on of the drive of the device for the feeding of the fibers, the yarn is cut in front of the yarn end that was formed during the stoppage, and that the piecing will then take place at the yarn end obtained by the cutting. Thus, the circumstance is taken into that the yarn end being formed by the switching-off of the feeding device, because of the occurring lack of fibers, in most cases is not suitable for a piecing process. The yarn is then returned so far and cut so that a yarn end is obtained that is suitable for a piecing process.

In a further development of the invention, it is provided that before the actual stoppage, the spinning unit is slowed down from its operational speed to a lower speed, where the drives are coordinated in such a way that an unchanged yarn count is spun at the reduced withdrawal speed. The open-end friction spinning takes place at very high speeds, especially at a high withdrawal speed for the yarn. In order to eliminate the disadvantage that at such high speeds a controlled positioning of the yarn end resulting from the interruption of the spinning process is extremely difficult, the open-end friction spinning unit and correspondingly, the whole spinning machine is slowed down to a lower speed, especially to a lower withdrawal speed so that the controlled stoppage and especially the controlled receiving of the yarn end are facilitated. In this case, the realization is utilized that it is possible in open-end friction spinning to reduce the operating speeds and still obtain a yarn of the same yarn count.

In a further development of the invention, it is provided that during the restarting, the drives are first accelerated to a speed that is lower than the operational speed and at which the piecing takes place, where the lower speed of the drives is coordinated in such a way that the same yarn count is spun that is spun at the operational speed after which the drives are accelerated to operational speed. In this manner, longer time periods are made available in which the individual steps of the piecing process take place so that the reliability of the piecing and the quality of the pieced points is increased.

In a further development of the invention, it is provided that the drives of the withdrawal device and of the wind-up device are reversed for returning the yarn end into the auxiliary device. This may take place immediately after the stoppage or as the first step of the restarting process.

In a further development of the invention, it is provided that during the stoppage, a yarn reserve is produced between the rollers and the withdrawal device which is used up for the return of the yarn end into the auxiliary suction device. Although the production of the yarn reserve takes place during the stoppage, the using-up of the yarn reserve may take place either as the last step of the stoppage or as the first step of the restarting process.

In a further development of the invention, it is provided that the drive of the rollers and/or the connection of the suction device to its vacuum source are interrupted during the return. As a result, the return of the yarn end into the auxiliary suction device is not disturbed by the rollers or the suction device.

In a further development of the invention, it is provided that in the area of the auxiliary suction device, a yarn clamp is provided that closes after the return of the yarn end. As a result, it is achieved that the yarn end is held securely in the desired position without the requirement of outside energy for the holding. When the return and the clamping-in of the yarn end take place immediately after the stoppage, even extended periods of stoppage of the open-end friction spinning unit or of the spinning machine cannot result in a change of the position of the yarn end.

In a further development of the invention, it is provided that the yarn clamp is kept closed during the start of the rollers and after the switching-on of the drives of the withdrawal device and of the wind-up device at the time of the restarting process. By means of this measure, a cutting of the held yarn takes place automatically at a distance from the actual end since the yarn, because it is taken along via the rollers receives a false twist which at one point results in an opening of the spinning twist of the yarn and thus in a cutting of the yarn when the withdrawal device is switched on. This twisted end of the yarn has a shape that is especially suitable for piecing.

Other objects, advantages and novel features of the present invention will become apparent from the following detailed description of the invention when considered in conjunction with the accompanying drawings.

DETAILED DESCRIPTION OF THE DRAWING

Figure 1:
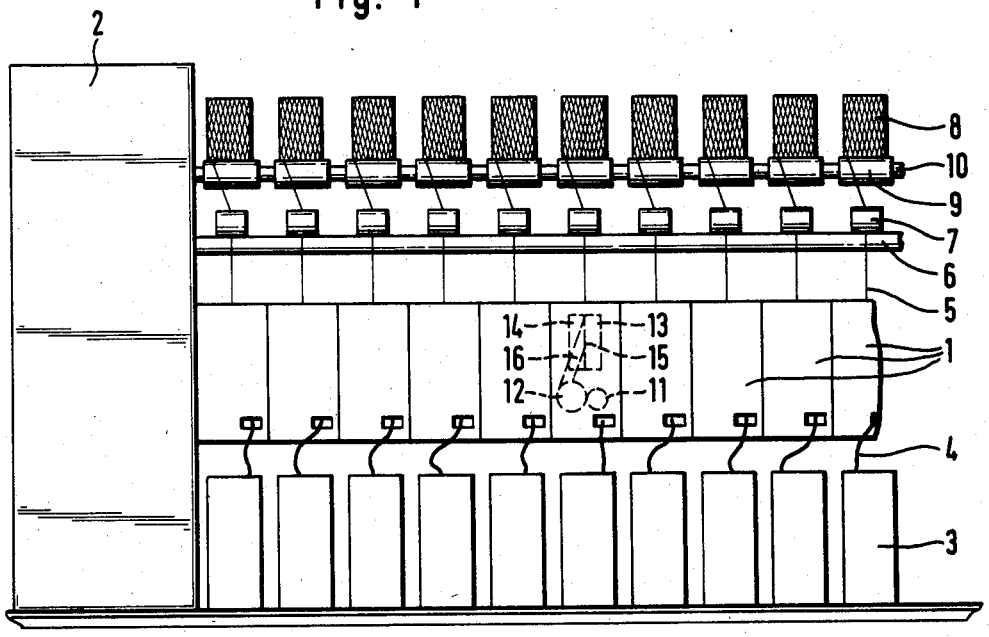
FIG. 1 is a schematic partial front view of a spinning machine constructed in accordance with referred embodiments of the invention and having a plurality of open-end friction spinning units.

The spinning machine shown in FIG. 1 has a plurality of open-end friction spinning units 1 arranged in a row next to one another. The driving motors for the individual driving elements are located in a headstock 2 on the front side, said headstock 2 representing the end of the spinning machine. The other end of the spinning machine on the front side ends with a corresponding headstock. This end is not shown.

A sliver 4 is fed to each open-end friction spinning unit 1 from a can 3 and is spun into a yarn 5. The spun yarn 5, by means of a withdrawal device consisting of a drivable bottom cylinder 6 running through in the longitudinal direction of the machine and one pressure roller 7 assigned to each open-end friction spinning unit 1, is withdrawn and subsequently wound onto a spool 8. The spools 8 of the open-end friction spinning units 1 are driven by grooved drums 9 arranged on a shaft 10 running through in the longitudinal direction of the machine, a drive in the headstock 2 being assigned to said shaft 10.

Figure 3:
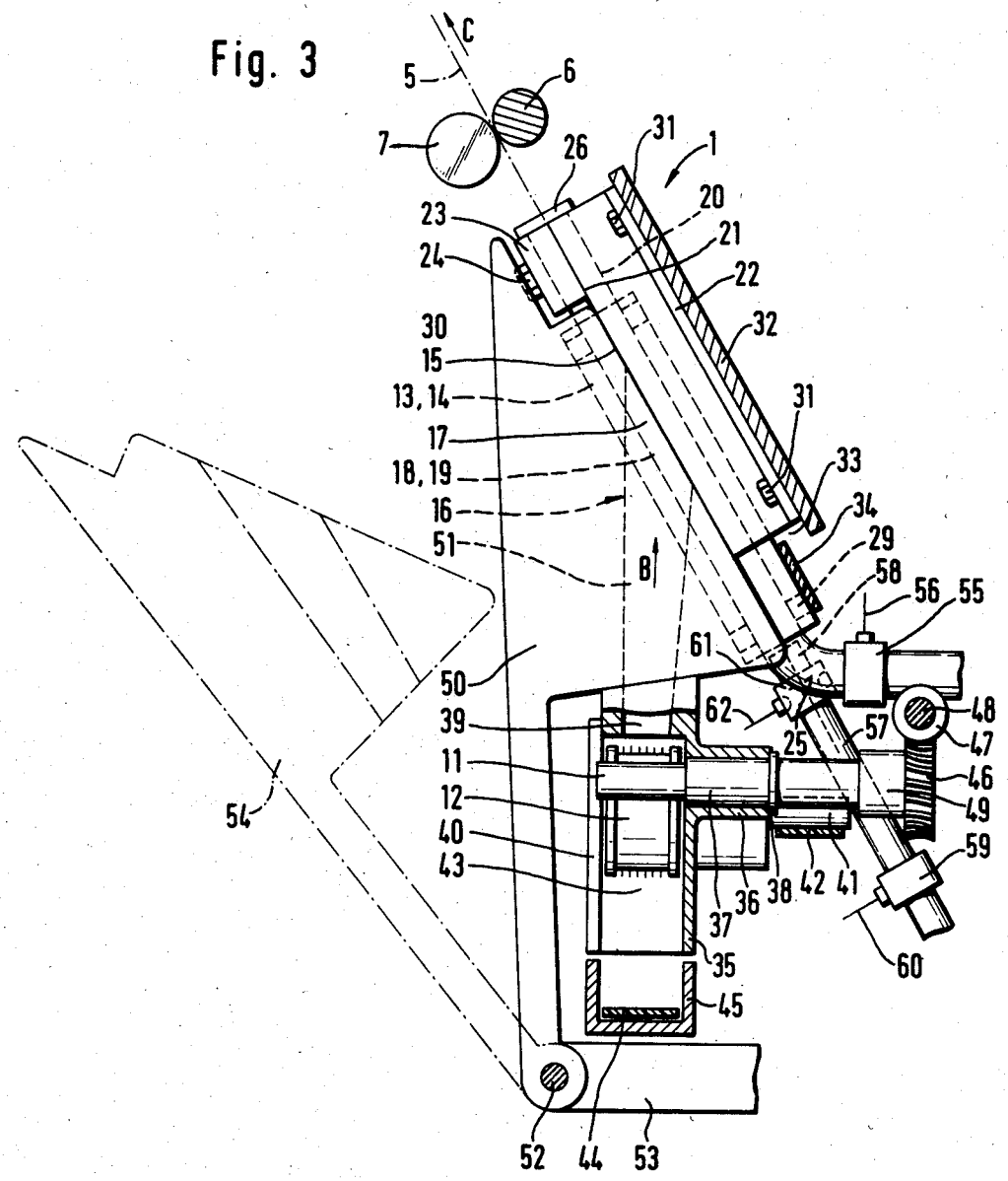
FIG. 3 is a schematic partial sectional lateral view of an individual open-end friction spinning unit corresponding to FIG. 2.

Each open-end friction spinning unit 1 contains a feeding roller 11 interacting with a feeding table that is not shown and in an elastic or resilient manner is pressed against said feeding roller 11, said feeding roller 11 pulling in the fed sliver 4. The feeding rollers 11 are driven by a central drive that will be explained later. In each open-end friction spinning unit 1 the fed sliver 4 is offered to a rapidly turning opening roller 12 which combs out the sliver 4 and separates it into individual fibers. In each open-end friction spinning unit 1, the individual fibers are led via a fiber feeding duct 16 to a wedge-shaped gap 15 formed by two friction rollers 13 and 14 arranged in parallel at a narrow distance next to one another. The twisting-together of the fibers into the yarn 5 takes place in this wedge-shaped gap. The direction of the fiber feeding (direction of Arrow B in FIG. 3) is at an acute angle with respect to the withdrawal direction (direction of the Arrow C, FIG. 3) of the yarn 5.

Figure 2:
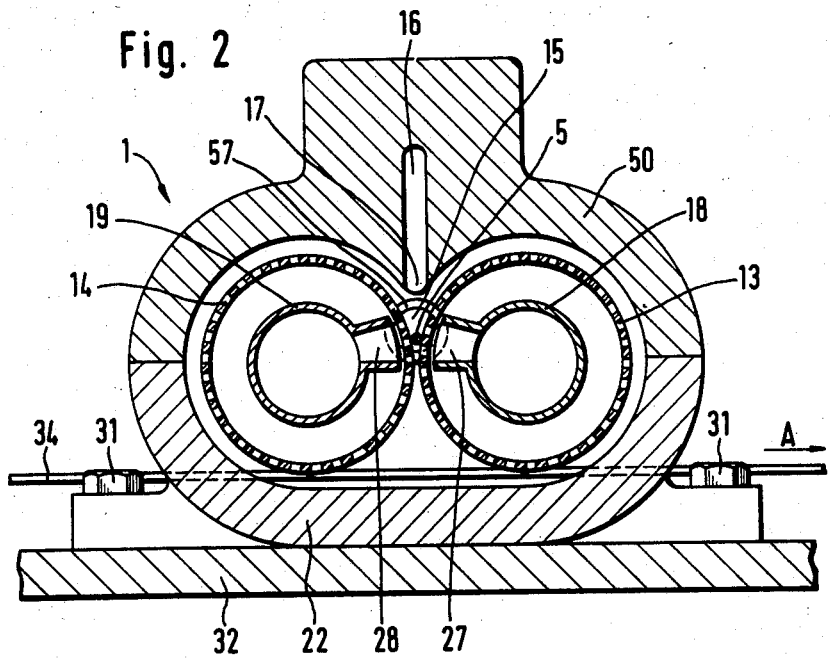
FIG. 2 is an enlarged schematic sectional view through an individual open-end friction spinning unit of the machine shown in FIG. 1.

The fiber feeding duct 16 (FIG. 2 and 3) has a flat rectangular shape and with its mouth 17 is aimed at the area of the wedge-shaped gap 15. The slot-shaped mouth 17 extends at a narrow distance from the wedge-shaped gap 15 in its longitudinal direction. The area of the mouth 17 forms the feeding point for the individual fibers, the so-called scatter zone, in which the actual formation of the yarn takes place in the wedge-shaped gap 15.

Within the friction rollers 13 and 14, suction tubes 18 and 19 are arranged which with one end 20 protrude from the upper facing sides of the friction rollers 13 and 14 and are clamped tightly there. The suction tubes are clamped tight in bowl-shaped recesses 21 of a roller housing 22 by means of tool holders 23 which, by means of screws 24, are fastened at the roller housing 22. The suction tubes 18 and 19 also project out of the other facing side of the friction rollers 13 and 14 with their ends 25 which, via a valve 55, are connected to a vacuum source that is not shown. The upper facing sides of the suction tubes 18 and 19 are closed by means of closing plugs 26. On the inside of the friction rollers 13 and 14, the suction tubes 18 and 19 are each provided with a longitudinal slot 27 and 28 which are opposite the area of the wedge-shaped gap 15 and are limited by webs led up to the inside contour of the friction rollers 13 and 14. The friction rollers 13 and 14, at least in the area extending over the length of the longitudinal slots 27 and 28 of their shell surfaces, are perforated so that an air current is sucked via the suction tubes into the area of the wedge-shaped gap 15 from the outside through the shell surfaces of the friction rollers 13 and 14. This air current is used for holding the forming yarn 5 and the fed fibers in the wedge-shaped gap 15 and also for causing the transport of the individual fibers fed in the direction of the Arrow B to the area of the wedge-shaped gap 15 or at least for supporting it.

The friction rollers 13 and 14 are disposed directly on the suction tubes 18 and 19 by means of roller bearings 29 and 30 in the area of their facing sides or ends. The roller housing 22 which is screwed by means of screws 31 to machine support 32, in the area facing away from the withdrawal device 6, 7, is provided with a recess 33 in the area of which a tangential belt 34 runs through the whole spinning machine in the direction of the Arrow A, said belt 34 running directly against the shell surfaces of the friction rollers 13 and 14 to drive same. A drive for the tangential belt is provided in the headstock 2. The tangential belt 34 is used for driving all friction rollers 13 and 14 of the open-end friction spinning units 1 of one side of the machine.

The opening roller 12 rotates in an opening roller housing 35 in which the opening roller 12 is disposed. The shank 41 of the opening roller 12 protrudes from the opening roller housing 35 and is driven by a tangential belt 42 running through in the longitudinal direction of the machine, the driving of said tangential belt 42 taking place also in the headstock 2.

The opening roller housing 35, by means of a sleeve-type extension 36, is fitted onto a tube 37 on the inside of which the feeding roller 11 is disposed. The opening roller housing with its sleeve-type extension 36 supports itself in axial direction against a ring collar 38 of the tube 37. The feeding roller 11 disposed in the tube 37, via an electromagnetic coupling 49, is connected to a toothed wheel 46 mating with a bevel wheel 47 arranged on a shaft 48 running through in the longitudinal direction of the machine. The shaft 48 is driven in the headstock 2.

The opening roller housing 35 is provided with a dirt disposal opening 43 in the circumferential area of the opening roller 12 provided with a set of needles or teeth. Via this dirt disposal opening 43, dirt that may be contained in the sliver is thrown off and is carried away by a dirt removal belt 44 running through in the longitudinal direction of the spinning machine. The dirt removal belt 44 runs in a trough 45 extending in the longitudinal direction of the machine.

Following the dirt disposal opening 43 in the transport direction of the combed-out fibers, the opening roller housing 35 is provided with a first section 39 of the fiber feeding duct 16 which is continued by a second section 51. The second section 51 of the fiber feeding duct 16 is a component of a partial housing 50 covering the friction rollers 13 and 14 toward the operating side. The partial housing 50 can be pivoted around a stationary shaft 52 of a machine support 53 into the dash-dotted position 54 for exposing the friction rollers 13 and 14.

An electromagnetic switching or control valve 55 is provided for each or jointly for both suction tubes 18 and 19, said valve 55, via an electric line 56, being connected to the machine control system. This valve 55 makes it possible to switch off the vacuum affecting the wedge-shaped gap 15 or to proportion it without having to switch the vacuum source itself for which advantageously a vacuum blower is provided in the headstock of the spinning machine. This permits a proportioning of the air current during the piecing process.

Each open-end friction spinning unit 1, in the area of the end faces of the friction rollers 13 and 14 facing away from the withdrawal device 6, 7, is provided with a suction tube 57 serving as an auxiliary suction device which is arranged as an extension of the widge-shaped gap 15. The suction tube 57, with its mouth 58, is led up to close to the assigned end faces of the friction rollers 13 and 14 in which case the mouth 58 is at least partially covered by the partial housing 50. A vacuum produced by the suction tube 57 therefore has an effect that reaches deep into the wedge-shaped gap 15. The suction tube 57 contains a preferably electromagnetic valve 59 which, via a line 60, is connected with the machine control system. The vacuum source for the suction tubes 18 and 19 can be used as the vacuum source for the auxiliary suction device.

The suction pipe 57 of the auxiliary suction device, in the area of its mouth 58, is also provided with a yarn clamp 61 which can be actuated also preferably electromagnetically and which is connected with the machine control system via a line 62.

Figure 5:
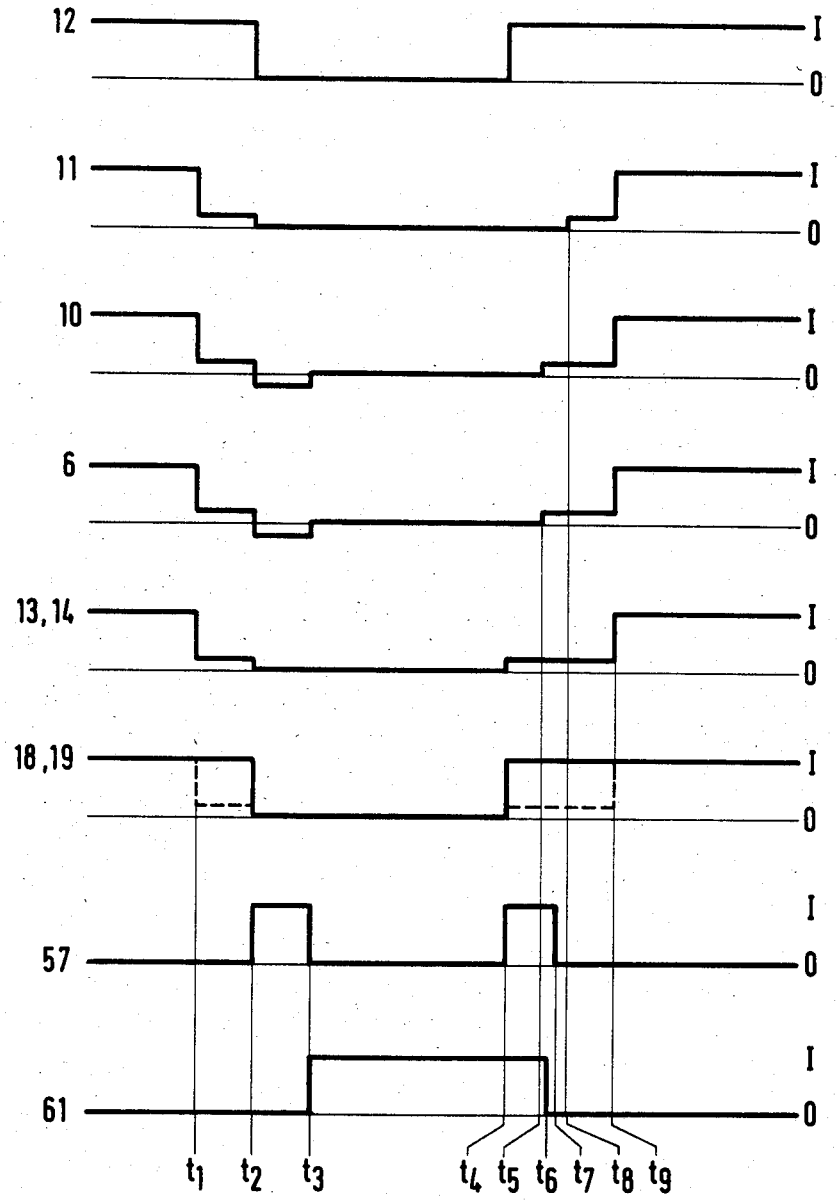
FIG. 5 is a diagram for explaining the time sequences during the stopping and the restarting process according to preferred embodiments of the present invention.

The stopping of an individual open-end friction spinning unit 1 and especially the stopping of the whole spinning machine takes place in such a way that when the device for the feeding of the fibers is turned off, i.e., the feeding roller 11 is stopped, the resulting yarn end does not leave the sphere of action of the auxiliary suction device, i.e., especially not the area of the wedge-shaped gap 15 that is still reached by the air current of the suction tube 57. This stopping is initiated at point in time $t_1$, and is carried out at point in time $t_2$. First the working speeds of the open-end friction spinning unit 1 or of the whole spinning machine are reduced to a lower value than that of the operational speeds. In this case, the coordination is selected in such a way that also at this lower speed, the same yarn count is spun. Although, the reduction in FIG. 5 is shown as a step, it is understood that naturally a continuous reduction of the speeds is also within the scope of the invention. The reducing of the speeds means that concretely the speeds of the feeding roller 11, of the shaft 10 driving the grooved rollers 9, of the bottom cylinders 6 of the withdrawal device and of the friction rollers 13 and 14 are reduced to correspondingly lower speeds. The speed of the opening roller 12 has no special influence so that it need not be reduced. If necessary, the air current acting in the wedge-shaped gap 15 may also be reduced by the valve 55 of the suction tubes 18 and 19, as indicated by interrupted lines in FIG. 5. From this reduced speed, the open-end friction spinning unit 1 or the whole spinning machine is then stopped at the point in time $t_2$. Together with this stoppage, the suction tube 57 of the auxiliary suction device is preferably at the same time connected to the vacuum source. Also preferably at the same time, the driving shaft 10 of the wind-up device and of the bottom cylinders 6 is reversed so that the yarn end formed by the interruption of the fiber feeding is returned and with an indicated length is sucked into the suction tube 57 of the auxilliary suction device. Subsequently, the final switching-off of the open-end friction spinning unit 1 or of the whole spinning machine takes place at a point in time $t_3$, in which case the yarn clamp 61 is closed at the same time. Advantageously, the yarn clamp 61 is constructed in such a way that by means of a power supply, it is held in the open position and after the turning-off of the power supply, it closes automatically.

For the restarting, at the point in time $t_4$, the drive of the friction rollers 13 and 14 is first switched on, preferably to a reduced speed. At the same time, the suction device is switched on, i.e., the suction pipes 18 and 19 are connected with the vacuum source. In this case, either the full suction effect may be produced immediately or a reduced suction effect corresponding to the interrupted line. At this point in time $t_4$, the drive of the opening roller 12 may also be switched on again which, however, may also take place at a later point in time, but in time with the switching-on of the drive of the bottom cylinder 6. At first remains closed the yarn clamp 61 to the point in time $t_6$. The yarn 5 located in the wedge-shaped gap 15 receives a false twist between the yarn clamp 61 and the withdrawal device 6, 7 which causes the yarn to be released from its spinning twist at an indicated point. By switching on the drives of the bottom cylinder 6 and of the shaft 10, the yarn withdrawal is started so that the yarn 5 is cut at the point where the spinning twist was undone. At this point in time $t_5$, the auxiliary suction device must be switched on in order to suck off the yarn end located in the suction tube 57 as waste. For this purpose, the yarn clamp 61 is opened at a point in time $t_6$, so that the sucking-off can take place. Advantageously, the suction tube 57 is connected to the vacuum source at the point in time $t_4$. At the point in time $t_7$, the suction tube 57 is detached from the auxiliary suction device. At the same time or shortly afterwards, the feeding of the fibers is started by a switching-on of the drive of the feeding roller 11. This point in time $t_8$ is coordinated in such a way that the yarn end formed by the cutting of the yarn 5 is located in the area of the scatter zone, i.e., of the mouth 17 of the fiber feeding duct 16, when the fibers are led into the area of the wedge-shaped gap 15. As a result, the piecing process takes place.

As shown in FIG. 5, the drives of the friction rollers 13, 14, of the bottom cylinder 6, of the shaft 10 and of the feeding roller 11 are first operated at reduced speeds in order to facilitate a piecing process. In this case, the coordination takes place in such a way that already at this point in time a yarn is spun the yarn number of which corresponds to that of the yarn spun under operational conditions. Subsequently, the drives, at a point in time $t_9$, are accelerated to operational speeds. Naturally, this acceleration may take place not only in steps but preferably continuously.

In the case of the representation according to FIG. 5, the step of the return of the yarn end into the auxiliary suction device is part of the switching-off program to be carried out at the time of the stoppage of the open-end friction spinning unit 1 or of the spinning machine. It is also contemplated to assign the operational steps to be carried out during the period between points in time $t_2$ and $t_3$ to the restarting program, i.e., as operational steps that precede the point in time $t_4$.

The restarting, especially of the whole spinning machine, is advantageously controlled by the program control system of the spinning machine. However, embodiments are also contemplated where a servicing apparatus is provided that can be applied to the individual open-end friction spinning units 1 which controls the restarting corresponding to the previously explained diagram at the individual open-end friction spinning units 1.

Figure 4:
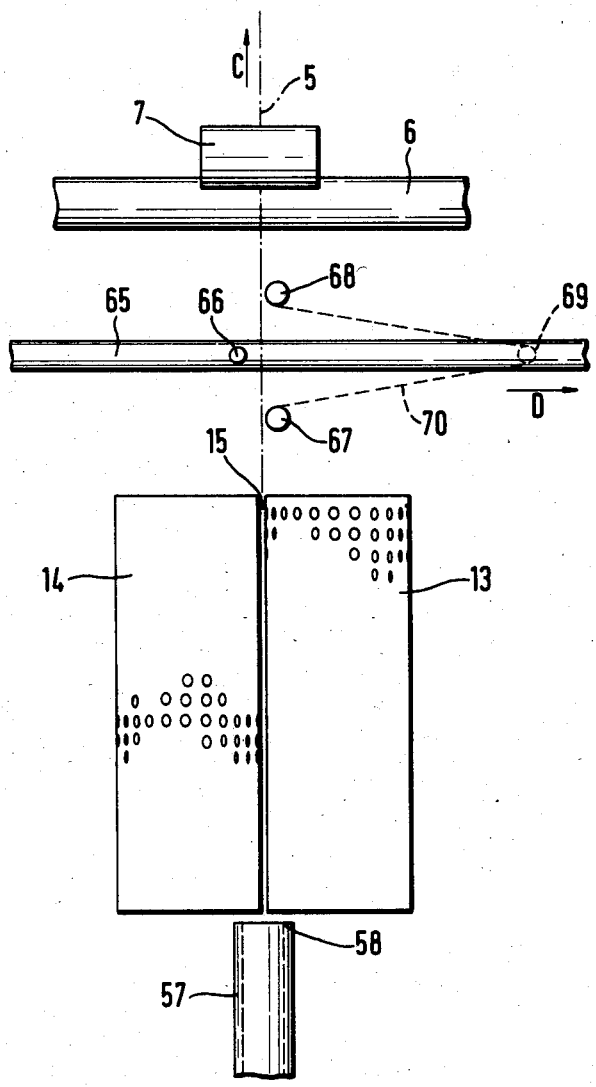
FIG. 4 is a schematic partial view of an open-end friction spinning unit having a device for producing a yarn reserveconstructed according to preferred embodiments of the invention.

In the case of the embodiment according to FIG. 4, a reversing of the drives of the bottom cylinder 4 and of the shaft 10 of the wind-up device is not necessary. A device is provided between the friction rollers 13 and 14 and the withdrawal device 6, 7 which produces a yarn reserve 70. This device includes two deflection guides 67 and 68 and a yarn guide 66 arranged on a transversely slidable yarn guide rod 65. Shortly before the final stoppage of the open-end friction spinning unit 1 or of the machine, the yarn guide rod 65, which is driven in the headstock 2 and is controlled by the machine control system, deflects the yarn guide 66 in the direction of the Arrow D to position 69 so that the yarn reserve is produced. This deflecting takes place shortly before the point in time $t_2$ in FIG. 5. Subsequently, the yarn guide rod 65 is returned to its initial position so that the yarn reserve 70 is released and the yarn end is sucked into the suction tube 57. The releasing of the yarn reserve may also not take place before the restarting of the open-end friction spinning unit 1 or of the whole machine according to certain preferred embodiments.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. A process for operating an open-end friction spinning machine of the type having at least one spinning unit with:

drivable friction surface means defining a yarn formation zone, friction surface driving means for driving the friction surface means during spinning operations, fiber feeding means for feeding separated fiber to the yarn formation zone, yarn withdrawal means for withdrawing formed yarn in the longitudinal direction of the yarn formation zone, suction means for applying suction forces to the yarn formation zone, yarn winding means for winding the spun yarn on a spool, and auxiliary suction means for holding a yarn end, said auxiliary suction means being configured to apply suction forces against the yarn withdrawal direction in the area of the yarn formation zone, said process comprising:

stopping of the friction surface driving means, interrupting of the fiber feeding means, switching off of the suction means, and activating the auxiliary suction means to hold a yarn end in such a manner that the yarn end formed by means of the interruption of the fiber feeding means remains in an area in which the suction force generated by the auxiliary suction means is capable of acting before a restarting of the spinning unit.

2. The process according to claim 1, wherein the drivable friction surface means comprises a pair of adjacently arranged friction rollers drivable in the same rotational direction and the yarn formation zone comprises a wedge shaped gap between the rollers.

3. A process according to claim 1, wherein one of the friction surface driving means and the connection of the suction means with its vacuum source is interrupted during the return of the yarn end for piecing.

4. A process according to claim 1, wherein, at the time of the restarting, before the switching-on of the drive of the device for the feeding of fibers, the yarn is cut in front of the yarn end that was formed during the stoppage, and wherein yarn piecing subsequently takes place to the yarn end obtained by the cutting.

5. A process according to claim 4, wherein during the restarting of the spinning unit for yarn piecing, the friction surface driving means, the fiber feeding means, and the yarn withdrawal means are first accelerated to speeds that are lower than the normal operational spinning speeds and at which the piecing takes place, these low speeds being coordinated in such a way that the same yarn count is spun that is spun at normal operational spinning speeds, after which these means are accelerated to the normal operational spinning speeds.

6. A process according to claim 4, wherein before the actual spinning unit stoppage, the spinning unit is slowed down from its operational speed to a lower speed, in which case the operation of the friction surface driving means, the fiber feeding means and the yarn withdrawal means are coordinated in such a way that during this phase, a yarn is spun that corresponds in yarn count to the yarn count spun at normal operational speeds.

7. A process according to claim 6, wherein the drives of the yarn withdrawal means and of the yarn winding means are reversed for the return of the yarn end into the auxiliary suction device.

8. A process according to claim 4, wherein in the area of the auxiliary suction means, a yarn clamp is provided that closes after the return of the yarn end.

9. A process according to claim 1, wherein before the actual spinning unit stoppage, the spinning unit is slowed down from its operational speed to a lower speed, in which case the operation of the friction surface driving means, the fiber feeding means and the yarn withdrawal means are coordinated in such a way that during this phase, a yarn is spun that corresponds in yarn count to the yarn count spun at normal operational speeds.

10. A process according to claim 9, wherein during the spinning unit stoppage, a yarn reserve is produced between the friction surface means and the yarn withdrawal means which is utilized for the return of the yarn end into the auxiliary suction device.

11. A process according to claim 1, wherein the drives of the yarn withdrawal means and of the yarn winding means are reversed for the return of the yarn end into the auxiliary suction device.

12. A process according to claim 1, wherein during the spinning unit stoppage, a yarn reserve is produced between the friction surface means and the yarn withdrawal means which is utilized for the return of the yarn end into the auxiliary suction device.

13. A process according to claim 1, wherein the friction surface driving means and the connection of the suction means with its vacuum source are interrupted during the return of the yarn end for piecing.

14. A process according to claim 1, wherein in the area of the auxiliary suction means, a yarn clamp is provided that closes after the return of the yarn end.

15. A process according to claim 14, wherein the yarn clamp, at the time of the restarting of the spinning unit during the starting of the friction surface drive means and after the switching-on of the drives of the yarn withdrawal means and of the wind-up device, is kept closed.

16. A process according to claim 1, wherein the drive of the fiber feeding means, at the time of the restarting of the spinning unit, is switched in a delayed manner with respect to the drive of the yarn withdrawal means and the yarn winding means.

17. A process according to claim 1, wherein said spinning machine has a plurality of commonly driven spinning units and wherein said coordinating includes coordinating simultaneously stopping a plurality of said spinning units in a similar manner.

* * * * *